US011441835B1

(12) United States Patent
Góss et al.

(10) Patent No.: US 11,441,835 B1
(45) Date of Patent: Sep. 13, 2022

(54) REFRIGERATOR APPLIANCE AND CONTAINMENT SYSTEM FOR CONTENTS OF REFRIGERATOR APPLIANCE

(71) Applicant: WHIRLPOOL CORPORATION, Benton Harbor, MI (US)

(72) Inventors: Isadora Camargo Góss, São Joaquim (BR); Luiz Afranio Alves Ferreira, Joinville (BR)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

(21) Appl. No.: 17/183,922

(22) Filed: Feb. 24, 2021

(51) Int. Cl.
*F25D 23/04* (2006.01)
*F25D 25/02* (2006.01)

(52) U.S. Cl.
CPC ..... *F25D 23/04* (2013.01); *F25D 25/02* (2013.01); *F25D 2331/803* (2013.01)

(58) Field of Classification Search
CPC ..... F25D 23/04; F25D 2331/803; F25D 2331/809; F25D 25/02; F25D 2331/805; F25D 31/007; A47B 73/008
See application file for complete search history.

(56) References Cited

U.S. PATENT DOCUMENTS

| | | | | |
|---|---|---|---|---|
| 2,666,613 | A | 1/1954 | Astleford | |
| 5,567,029 | A * | 10/1996 | Haenisch | F25D 23/04 211/100 |
| 7,207,538 | B2 | 4/2007 | Kent-Fawkes | |
| 7,610,774 | B2 | 11/2009 | Anderson et al. | |
| 8,313,007 | B2 | 11/2012 | Kpabar | |
| 8,336,976 | B2 | 12/2012 | Lee | |
| 8,746,818 | B2 * | 6/2014 | Meese | F25D 23/04 312/405.1 |
| 9,671,154 | B1 * | 6/2017 | Shrader | F25D 23/04 |
| 10,492,606 | B2 | 12/2019 | Schaefer et al. | |
| 2010/0058776 | A1 * | 3/2010 | Loibl | F25D 31/007 62/3.3 |
| 2017/0108270 | A1 * | 4/2017 | Zhang | F25D 23/066 |
| 2017/0321954 | A1 * | 11/2017 | Shrader | F25D 23/04 |

FOREIGN PATENT DOCUMENTS

| | | | | |
|---|---|---|---|---|
| CA | 1167510 | A * | 5/1984 | A47B 43/00 |
| CN | 102353227 | A | 2/2012 | |
| CN | 102538374 | B | 5/2014 | |
| CN | 206019146 | U | 3/2017 | |
| CN | 206094728 | U | 4/2017 | |
| CN | 106679305 | A | 5/2017 | |
| CN | 208365901 | U | 1/2019 | |

(Continued)

*Primary Examiner* — Hiwot E Tefera
(74) *Attorney, Agent, or Firm* — Brooks Kushman P.C.

(57) ABSTRACT

A containment system for a refrigerator includes a storage bin and a support arm. The storage bin is secured to an internal panel of a refrigerator door. The support arm is secured to the interior panel at a position above the storage bin. The support arm is configured to transition between a retracted position that is adjacent to a back surface of the internal panel and an advanced position that is spaced apart from the back surface. The support arm in the advanced position is configured to engage a food container that is positioned in the storage bin such that the food container is disposed between the support arm and the back surface.

20 Claims, 4 Drawing Sheets

(56) References Cited

FOREIGN PATENT DOCUMENTS

| | | | | | |
|---|---|---|---|---|---|
| DE | 4304502 | A1 * | 8/1994 | ..... | A47B 96/06 |
| EP | 1608922 | B1 | 4/2007 | | |
| KR | 19990021451 | A | 3/1999 | | |
| KR | 200161927 | Y1 | 12/1999 | | |
| KR | 20040016247 | A | 2/2004 | | |
| KR | 20070093291 | A | 9/2007 | | |
| KR | 101188513 | B1 | 10/2012 | | |
| WO | WO-2011029756 | A1 * | 3/2011 | ..... | F25D 25/02 |

* cited by examiner

REFRIGERATOR APPLIANCE AND CONTAINMENT SYSTEM FOR CONTENTS OF REFRIGERATOR APPLIANCE

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator appliance includes walls, a door, and a support arm. The walls define an internal storage chamber. The door is rotatably secured to the walls. The door has a liner that is configured to face the internal storage chamber when the door is in a closed position. The liner defines a storage bin. The support arm is secured to the liner at a position above the storage bin. The support arm is configured to transition between a retracted position that is adjacent to a back surface of the liner and an advanced position that is spaced apart from the back surface of the liner. The support arm in the advanced position is configured to engage a food container that is disposed in the storage bin such that the food container is disposed between the support arm and the back surface of the liner in order to maintain the position of and prevent the food container from falling over.

A refrigerator door includes an exterior panel, an interior panel, a shelf, and a support arm. The interior panel is disposed on an internal side of the exterior panel. The interior panel has a back surface. The shelf extends from the back surface. The support arm is secured to the interior panel at a position above the shelf. The support arm is configured to transition between a retracted position that is adjacent to the back surface and an advanced position that is spaced apart from the back surface. The support arm in the advanced position is configured to engage a food container that is resting on the shelf such that the food container is disposed between the support arm and the back surface of the interior panel.

A containment system for a refrigerator includes a storage bin and a support arm. The storage bin is secured to an internal panel of a refrigerator door. The support arm is secured to the interior panel at a position above the storage bin. The support arm is configured to transition between a retracted position that is adjacent to a back surface of the internal panel and an advanced position that is spaced apart from the back surface. The support arm in the advanced position is configured to engage a food container that is positioned in the storage bin such that the food container is disposed between the support arm and the back surface.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
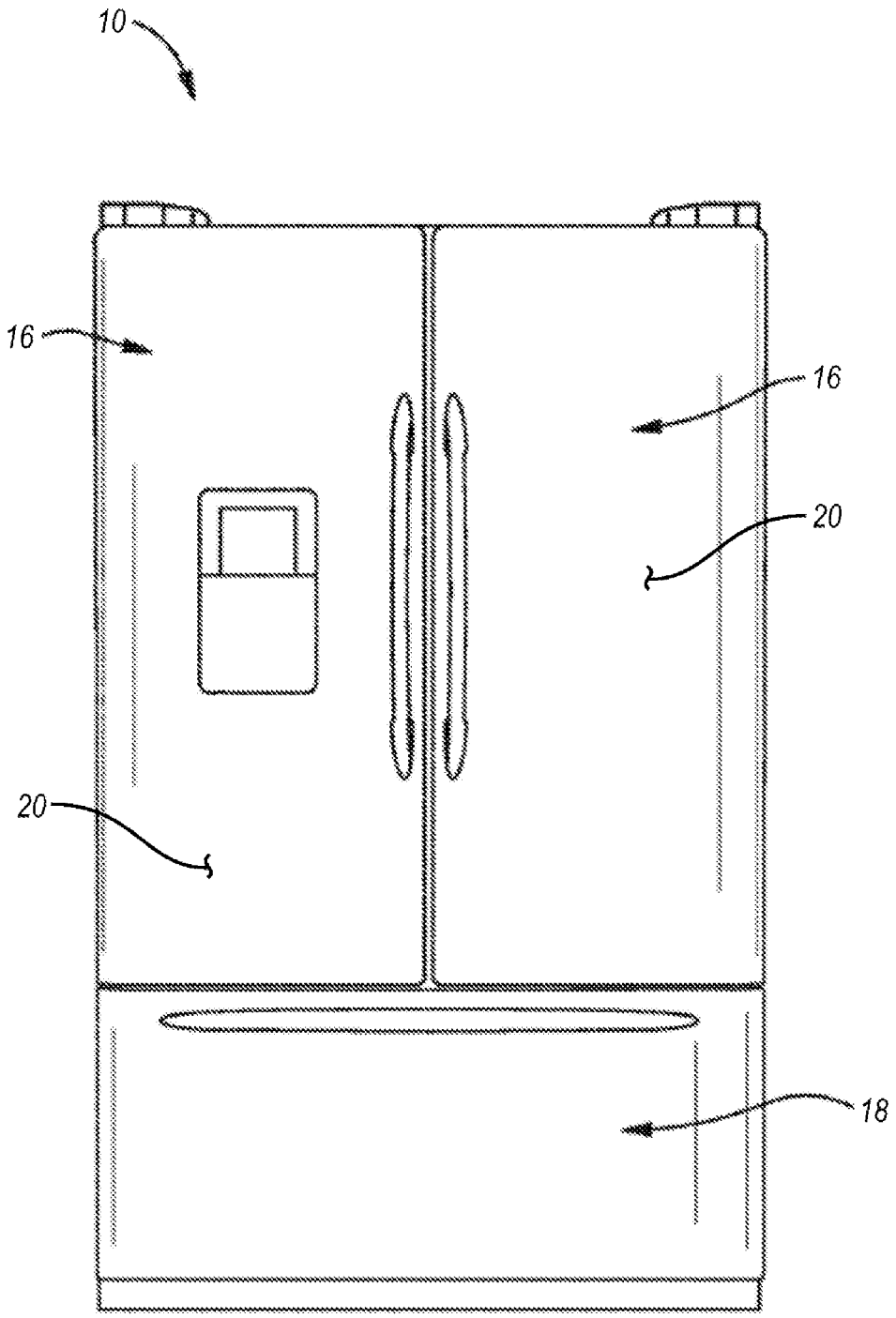
FIG. 1 is an elevated front view of a French-Door Bottom Mount type refrigerator appliance.
Figure 2:
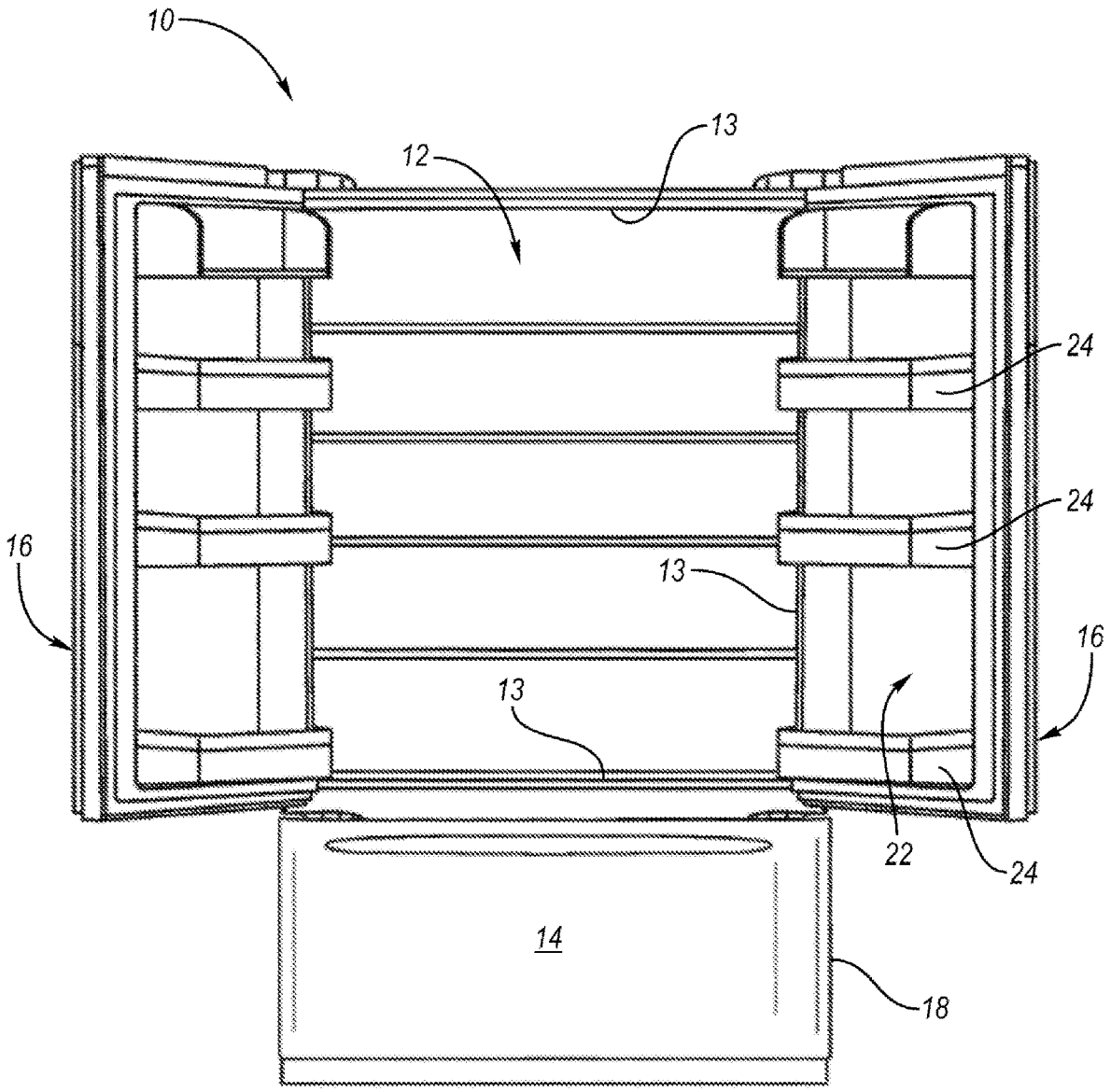
FIG. 2 is an elevated front view of a French-Door Bottom Mount type refrigerator with the refrigerator compartment doors open.
Figure 3:
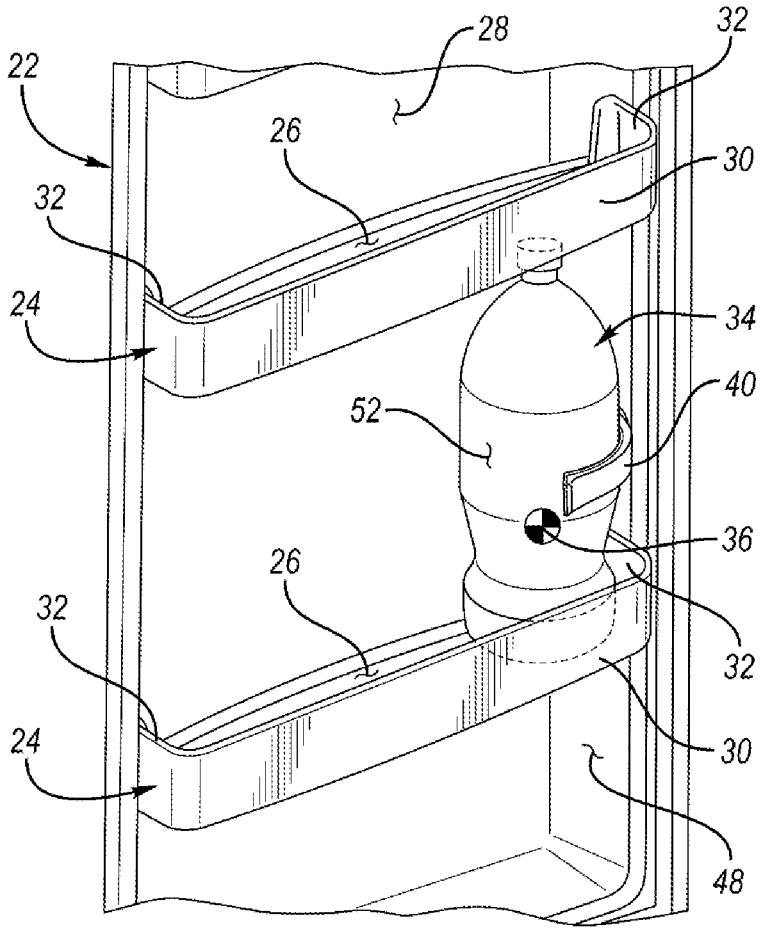
FIG. 3 is a perspective view of a portion of an internal side of one of the compartment doors illustrating a food container containment system.
Figure 4:
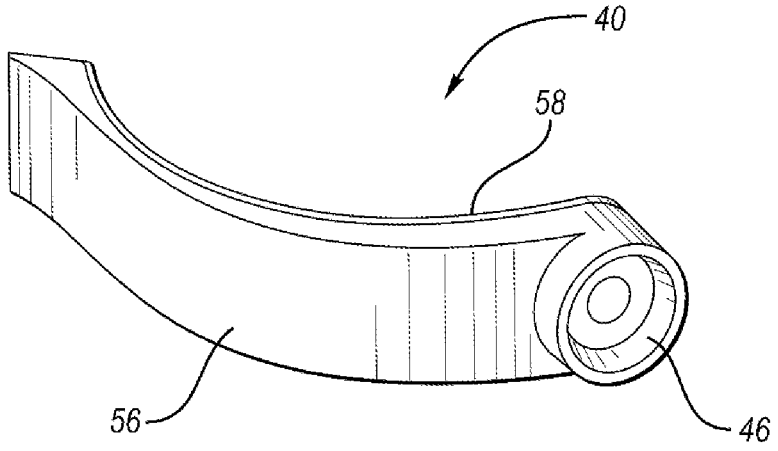
FIG. 4 is a perspective backside view of a support arm of the food container containment system.
Figure 5:
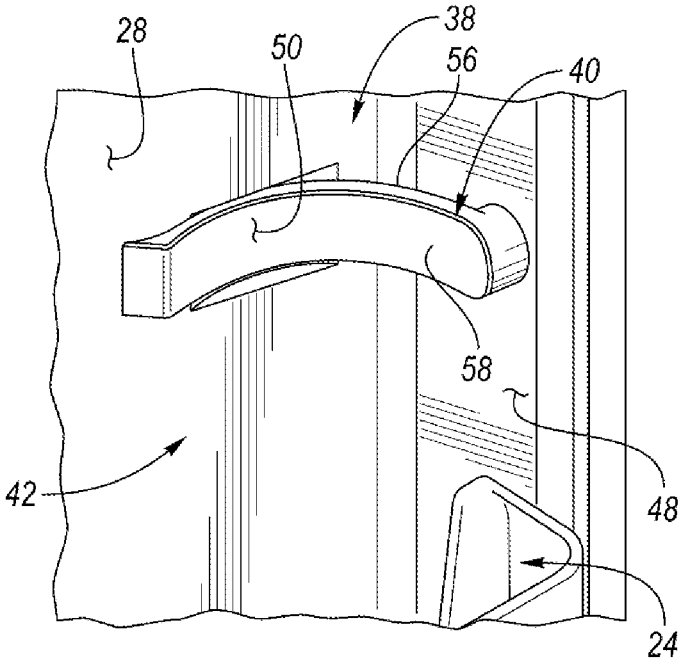
FIG. 5 is a perspective frontside view of the food container containment system with the support arm in a retracted position.
Figure 6:
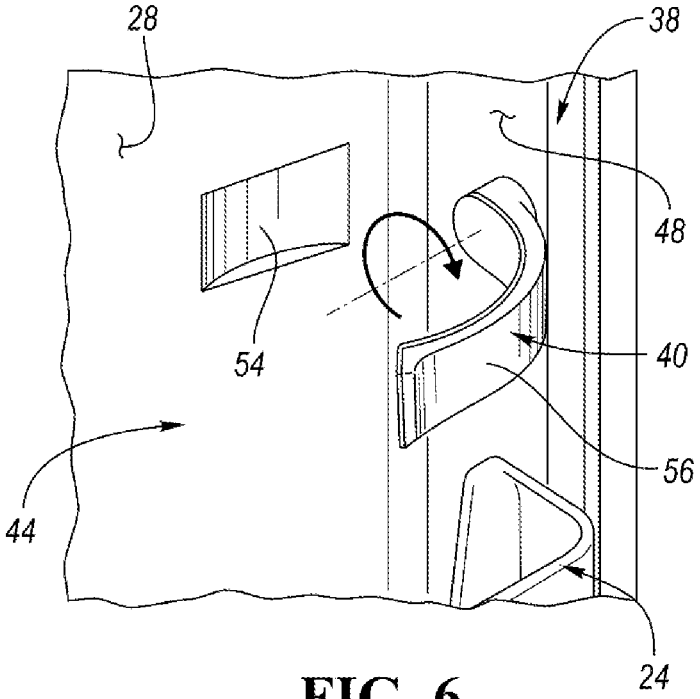
FIG. 6 is a perspective frontside view of the food container containment system with the support arm in an advanced position.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 includes walls 13 that define the fresh food compartment 12 and the freezer compartment 14. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

Referring now to FIGS. 2-6, the doors 16 may also include storage bins 24 that are able to hold smaller food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves 26 (e.g., a lower surface upon, which a food item or container may rest upon) that extend from back surfaces 28 of the interior panels 22 of each door 16.

The storage bins 24 may also include front walls 30, side walls 32, and rear walls. The storage bins 24 are open along topsides of the storage bins 24. The rear walls may be a portion of the back surfaces 28 of the interior panels 22. The front walls 30, side walls 32, and rear walls may be substantially perpendicular to the shelves 26. Substantially perpendicular may refer to any incremental angle that is between exactly perpendicular to 15° from exactly perpendicular.

Food items or containers (e.g., container 34 in FIG. 3) may be subject to falling over within the storage bins 24 or falling out of the storage bins 24 when the doors 16 are transitioned between the opened and closed positions, illustrated in FIGS. 2 and 1, respectively. The food items or containers may be particularly subject to falling over within the storage bins 24 or falling out of the storage bins 24 when there are no adjacent food items to prevent the food items or containers from sliding around within the storage bins 24 or when a center of mass of the food item or container is (e.g., center of mass 36 of container 34 in FIG. 3) is at a relatively higher position than the walls (i.e., front walls 30, side walls 32, and rear walls) of the storage bins 24.

In order to prevent the food items or containers from falling over within the storage bins 24 or falling out of the storage bins 24, the refrigerator 10 may include a food containment system or food container containment system 38 that may be configured to maintain the position of a food item or food container (e.g., food container 34). The food containment system or food container containment system 38 may also be configured to prevent a food item or food container that is resting on the shelf 26 of one of the storage bins 24 from falling over within the respective storage bin 24 or from falling out of the respective storage bin 24, particularly when the door 16 that the respective storage bin 24 is connected to is transitioned between the opened and closed positions.

The food containment system or food container containment system 38 includes one of the storage bins 24 and a support arm 40 that is secured to the interior panel 22 of one of the doors 16 at a position above the respective storage bin 24. The support arm 40 is configured to transition between a retracted position 42 (e.g., FIG. 5) that is adjacent to the back surface 28 of the interior panel 22 and an advanced position 44 (e.g., FIGS. 3 and 6). The interior panel 22 or portions of the interior panel 22 may also form a portion of the food containment system or food container containment system 38.

In the advanced position 44, the support arm is spaced apart from the back surface 28 of the interior panel 22. In the advanced position 44, the support arm 40 is configured to engage a food item or container (e.g., food container 34) that is resting on the shelf 26 of and is at least partially disposed in the storage bin 24 that is directly below the support arm 40, such that the food item or container is disposed between the support arm 40 and the back surface 28 of the interior panel 22. Such a configuration maintains the position of and prevents the food item or container from falling over within the storage bin 24 or from falling out of the storage bin 24. In order to further increase the stability of the food item or container (i.e., to further decrease the probability of the food item or container from falling over with the storage bin 24) that is disposed within the storage bin 24, the support arm 40 may more specifically be configured to engage the food item or container at a position that is located above a center of mass of the food item or container (e.g., center of mass 36 of food container 34).

The support arm 40 may be rotatably secured to the interior panel 22 of one of the doors 16 via a pin or pivot 46. The support arm 40 may then be configured to rotate about the pivot 46 between the retracted position 42 and the advanced position 44. More specifically, the support arm 40 may be secured to a side surface 48 of the interior panel 22. The side surface 48 of the interior panel 22 may be substantially perpendicular to the back surface 28 of the interior panel 22. Substantially perpendicular may refer to any incremental angle that is between exactly perpendicular to 15° from exactly perpendicular.

The support arm 40 may have an arc-shaped internal surface 50 that is configured to engage a cylindrical outer surface of a food item or food container. For example, the food container 34 may include cylindrical outer surface 52, and the arc-shaped internal surface 50 of the support arm 40 may be configured to engage the cylindrical outer surface 52 of the food container 34 to maintain the position of the food container 34 within the storage bin 24. The back surface 28 of the interior panel 22 may define a notch 54 that is configured to receive the support arm 40 when the support arm 40 is in the retracted position 42. The notch 54 may also be arc-shaped to interact with an overall arc-shaped of the support arm 40.

The support arm 40 has a structural frame 56 and a coating material 58 that is disposed over a portion of the structural frame 56. More specifically, the coating material 58 may form the arc-shaped internal surface 50. The coating material 58 may have a coefficient of friction that is greater than a coefficient of friction of the structural frame 56, so that the coating material 58 may properly engage or grip onto a food item or food container in order to prevent the food item or food container from falling over or out of the storage bin 24. The structural frame 56 may provide rigidity to the support arm 40. The structural frame 56 may be made from a rigid plastic, such as a hard plastic, while the coating material may be made from a softer less rigid material, such as a soft plastic or rubber.

It should be understood that although only one food containment system or food container containment system 38 is illustrated herein, the refrigerator 10 may include more than one food containment system or food container containment system 38, the food containment system or food container containment system 38 may disposed on either door 16, 18, and/or the food containment system or food container containment system 38 may be a mirror image of what is illustrated in the figures. It should be further understood that the designations of first, second, third, fourth, etc. for any component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

walls defining an internal storage chamber;

a door rotatably secured to the walls, having a liner that is configured to face the internal storage chamber when the door is in a closed position, wherein (i) the liner defines a storage bin, (ii) has a back surface, and (iii) has a side surface that is substantially perpendicular to the back surface; and a support arm secured to the side surface in cantilevered manner at a position above the storage bin, wherein the support arm (i) has an internal surface, (ii) is configured to transition between a retracted position where the support arm is adjacent to the back surface and the internal surface faces away from the back surface and an advanced position where the support arm is spaced apart from the back surface and the internal surface faces toward the back surface, and (iii) in the advanced position the support arm is configured to engage a food container that is disposed in the storage bin such that the food container is disposed between the support arm and the back surface of the liner in order to maintain the position of and prevent the food container from falling over.

2. The refrigerator appliance of claim 1, wherein the support arm is rotatably secured to the side surface via a pivot.

3. The refrigerator appliance of claim 2, wherein the support arm is configured to rotate about the pivot between the retracted position and the advanced position.

4. The refrigerator appliance of claim 3, wherein the retracted position is substantially 180° from the advanced position.

5. The refrigerator appliance of claim 1, wherein the support arm in the advanced position is configured to engage the food container above a center of mass of the food container.

6. The refrigerator appliance of claim 1, wherein the support arm has an arc-shaped profile, the back surface of the liner defines a notch having a corresponding arc-shaped profile configured to receive a middle section of the arc-shaped profile of the support arm when the support arm is in the retracted position.

7. The refrigerator appliance of claim 1, wherein the internal surface is arc-shaped and is configured to engage a cylindrical outer surface of the food container.

8. A refrigerator door comprising:

an exterior panel;

an interior panel disposed on an internal side of the exterior panel, the interior panel having a back surface and side surface that is substantially perpendicular to the back surface;

a shelf extending from the back surface; and a support arm secured to the side surface in a cantilevered manner at a position above the shelf, wherein the support arm (i) has an internal surface, (ii) is configured to transition between a retracted position where the support arm is adjacent to the back surface and the internal surface faces away from the back surface and an advanced position where the support arm is spaced apart from the back surface and the internal surface faces toward the back surface, and (iii) in the advanced position the support arm is configured to engage a food container that is resting on the shelf such that the food container is disposed between the support arm and the back surface of the interior panel.

9. The refrigerator door of claim 8, wherein the support arm is rotatably secured to the side surface via a pivot.

10. The refrigerator door of claim 9, wherein the support arm is configured to rotate about the pivot between the retracted position and the advanced position.

11. The refrigerator door of claim 10, wherein the retracted position is substantially 180° from the advanced position.

12. The refrigerator door of claim 8, wherein the support arm in the advanced position is configured to engage the food container above a center of mass of the food container.

13. The refrigerator door of claim 8, wherein the support arm has an arc-shaped profile, the back surface of the interior panel defines a notch having a corresponding arc-shaped profile configured to receive a middle section of the arc-shaped profile of the support arm when the support art is in the retracted position.

14. The refrigerator door of claim 8, wherein the internal surface is arc-shaped and is configured to engage a cylindrical outer surface of the food container.

15. The refrigerator door of claim 14, wherein the support arm has a structural frame and a coating material that is disposed over a portion of the structural frame, wherein the coating material forms the arc-shaped internal surface and has a coefficient of friction that is greater than a coefficient of friction of the structural frame.

16. A containment system for a refrigerator comprising:

a storage bin secured to an interior panel of a refrigerator door, the interior panel having (i) a back surface and (ii) a side surface that is substantially perpendicular to the back surface; and a support arm secured to the side surface in a cantilevered manner at a position above the storage bin, wherein the support arm (i) has an internal surface, (ii) is configured to transition between a retracted position where the support arm is adjacent to the back surface and the internal surface faces away from the back surface and an advanced position where the support arm is spaced apart from the back surface and the internal surface faces toward the back surface, and (iii) in the advanced position the support arm is configured to engage a food container that is positioned in the storage bin such that the food container is disposed between the support arm and the back surface.

17. The containment system of claim 16, wherein the support arm is rotatably secured to the side surface via a pivot, and wherein the support arm is configured to rotate about the pivot between the retracted position and the advanced position.

18. The containment system of claim 17, wherein the retracted position is substantially 180° from the advanced position.

19. The containment system of claim 16, wherein the support arm has an arc-shaped profile, the back surface of the interior panel defines a notch having a corresponding arc-shaped profile configured to receive a middle section of the arc-shaped profile of the support arm when the support arm is in the retracted position.

20. The containment system of claim 16, wherein the internal surface is arc-shaped and is configured to engage a cylindrical outer surface of the food container, and wherein the support arm has a structural frame and a coating material that is disposed over a portion of the structural frame, wherein the coating material forms the arc-shaped internal surface and has a coefficient of friction that is greater than a coefficient of friction of the structural frame.

* * * * *